US010214867B2

(12) United States Patent
Stevanato et al.

(10) Patent No.: US 10,214,867 B2
(45) Date of Patent: Feb. 26, 2019

(54) TERMINAL FOR ROAD CRASH BARRIER

(71) Applicant: Obex Systems Ltd., Smithfield, Dublin (IE)

(72) Inventors: Alberto Stevanato, Mirano (IT); Patrick O'Reilly, Rathgar (IE)

(73) Assignee: Obex Systems Ltd., Smithfield (IE)

( * ) Notice: Subject to any disclaimer, the term of this patent is extended or adjusted under 35 U.S.C. 154(b) by 0 days.

(21) Appl. No.: 15/532,379

(22) PCT Filed: Dec. 1, 2015

(86) PCT No.: PCT/EP2015/078229
§ 371 (c)(1),
(2) Date: Jun. 1, 2017

(87) PCT Pub. No.: WO2016/087448
PCT Pub. Date: Jun. 9, 2016

(65) Prior Publication Data

US 2017/0362788 A1 Dec. 21, 2017

(30) Foreign Application Priority Data

Dec. 1, 2014 (GB) ..... 1421308.6

(51) Int. Cl.
*E01F 15/14* (2006.01)

(52) U.S. Cl.
CPC ..... *E01F 15/146* (2013.01); *E01F 15/143* (2013.01)

(58) Field of Classification Search
CPC ..... E01F 13/12; E01F 13/02; E01F 15/088; E01F 15/006; E01F 15/0492; E01F 15/086; E01F 15/146; E01F 15/143; E01F 15/141
See application file for complete search history.

(56) References Cited

U.S. PATENT DOCUMENTS

| | | | | |
|---|---|---|---|---|
| 4,452,431 | A * | 6/1984 | Stephens | E01F 15/146 256/13.1 |
| 5,791,812 | A * | 8/1998 | Ivey | E01F 15/143 256/13.1 |
| 6,409,417 | B1 * | 6/2002 | Muller | E01F 15/143 256/13.1 |
| 8,894,318 | B2 * | 11/2014 | Sayre | C08G 18/10 404/6 |
| 8,974,142 | B2 * | 3/2015 | Buehler | E01F 15/146 404/10 |
| 2002/0024043 | A1 * | 2/2002 | Albritton | E01F 15/143 256/13.1 |
| 2003/0057410 | A1 * | 3/2003 | Denman | E01F 15/146 256/13.1 |
| 2008/0308780 | A1 * | 12/2008 | Sloan | E01F 13/12 256/31 |

(Continued)

FOREIGN PATENT DOCUMENTS

DE 202008018355 * 8/2013

*Primary Examiner* — Abigail A Risic
(74) *Attorney, Agent, or Firm* — Servilla Whitney LLC

(57) ABSTRACT

A terminal for an end portion of a road crash barrier, comprising: a plurality of energy absorbing modules arranged in a linear formation along a longitudinal axis, each module defining a hollow section; and at least two anchors for anchoring the one or more energy absorbing modules, wherein at least one of the energy absorbing modules is supported by a flexible linear member between the at least two anchors.

21 Claims, 7 Drawing Sheets

(56) References Cited

U.S. PATENT DOCUMENTS

| | | | | |
|---|---|---|---|---|
| 2010/0207087 | A1* | 8/2010 | James | E01F 15/025<br>256/13.1 |
| 2016/0265177 | A1* | 9/2016 | Rohde | E01F 15/143 |
| 2017/0016191 | A1* | 1/2017 | Sicking | E01F 15/146 |
| 2017/0275837 | A1* | 9/2017 | Rohde | E01F 15/043 |

* cited by examiner

TERMINAL FOR ROAD CRASH BARRIER

FIELD

The present invention is related to a terminal for an end portion of a road crash barrier, which is configured to reduce damage to vehicles, objects and people following head-on and/or side collisions against the start and/or end of any road barrier or against any fixed obstacle.

BACKGROUND OF THE INVENTION

Traffic or crash barriers keep vehicles within the roadway and prevent vehicles from colliding with dangerous obstacles such as boulders, buildings, walls or drains. Side and centre crash barriers for roads such as motorways are respectively installed on sides and central reserves of divided highways to prevent errant vehicles from entering the opposing carriageway of traffic and help to reduce head-on collisions. Such crash barriers generally consist of a metal strip, transversally corrugated, supported by vertical columns that are anchored to the ground. These crash barriers are designed to minimize injury to vehicle occupants. However, injuries inevitably occur in collisions with crash barriers.

Early crash barrier designs often paid little attention to the ends or terminals of the barriers, so the barriers either ended abruptly in blunt ends, or sometimes featured some flaring of the edges away from the side of the barrier facing traffic. Vehicles that struck blunt terminals at the incorrect angle could stop too suddenly or have steel rail sections penetrate into the vehicle, resulting in severe injuries or fatalities. As a result, a new style of barrier terminals was developed in the 1960s in which the guardrail was twisted 90 degrees and its end laid down so that it would lie flat at ground level (so-called "turned-down" terminals). While this innovation prevented the rail from penetrating the vehicle, it could also cause a vehicle to vault into the air or cause it to roll over, since the rising and twisting guardrail formed a ramp. These crashes often led to vehicles flying at high speed into the very objects which the crash barriers were supposed to protect them from in the first place.

To address vaulting and rollover crashes, energy or shock-absorbing terminals were developed. These devices are known as end terminals or 'end treatments' of crash barriers. The first generation of these terminals in the 1970s were breakaway cable terminals, in which the rail curves back on itself and is connected to a cable that runs between the front and rear posts (which are often breakaway posts). The second generation, in the 1990s and 2000s, featured a large steel impact head that engages the frame or bumper of the vehicle. The impact head is driven back along the guide rail, dissipating the kinetic energy of the vehicle by bending or tearing the steel in the guide rail sections. A guide rail may also be terminated by curving it back to the point that the terminal is unlikely to be hit end-on, or, if possible, by embedding the end in a hillside or cut slope.

End terminals have been tested to comply with the EN1317 standard. EN 1317 is a European standard established in 1998 that defines common testing and certification procedures for road restraint systems. End terminals in the main are formed with corrugated or box beams on posts. Components interact with each other to absorb the impact of vehicles through friction, sliding, or shearing.

Some end terminals involve a tension-based solution rather than compression-based. The energy is absorbed with resistance at the impact head rather than being transferred down the rail as occurs with other systems. Even head on, high angle impacts result in the vehicle being redirected and controlled.

FIGS. 1*a* to 1*b* illustrate examples of conventional end terminals for crash barriers. As illustrated in FIGS. 1*a* and 1*b*, end terminals are configured to be attached to the terminal portions of crash barriers. FIG. 1*c* illustrates an example of another type of vehicle restraint device, namely a crash cushion. A crash cushion may comprise a number of water-filled shock absorbers in a grid formation. Crash cushions are standalone shock absorbers that are used to shield concrete barriers or guardrail ends in central reserves or roadsides. Crash cushions can be installed as a permanent or temporary attenuator. Redirective, non-gating crash cushions are road safety devices whose primary function is to protect the end of rigid or semi-rigid barriers or fixed roadside hazards by absorbing the kinetic energy of impact or by allowing controlled redirection of the vehicle. Crash cushion devices are designed to safely decelerate vehicles or redirect errant vehicles away from roadside or median hazards. These devices are typically applied to locations where head-on and angled impacts are likely to occur and it is desirable to have the majority of post impact trajectories on the impact side of the system. In one type of a crash cushion, energy absorbing cartridges can be used to absorb the kinetic energy of an impacting vehicle. The energy absorbing cartridges may be separated by diaphragms and held in place with a framework of corrugated steel rail panels that telescopes rearward during head-on impacts.

An alternative to energy absorbing barrier terminals are impact attenuators. FIG. 1*d* is an example of an impact attenuator, as disclosed in WO2012074480 (A1). Referring to FIG. 1*d*, this type of impact attenuator comprises a housing, at least two pins arranged in the housing which are arranged in parallel to each other in the housing, as well as a metallic, elongated draw element, which can be positioned within the housing such that it extends between and in contact with the pins, wherein the pins and the draw element are positioned such that a change of direction appears on the draw element when passing by each pin such that at mutual moving of the draw element and the housing in relation to each other, the movement is decelerated due to deformation of the draw element at passage of each pin. The pins and the draw element are positioned such that the draw element obtains a change of direction of at least 90 degrees when passing at least two of the pins. The impact attenuator comprises a beam and a collision catcher, which is connected to the beam and displaceable along its outer side, wherein one of the energy absorbing device or the draw element is connected to the collision catcher and displaceable together with it, while the other of these is fixedly connected to the ground or a fixed structure such that at a possible collision with the collision catcher, this is decelerated due to the mutual movement between the energy absorbing device and the draw element.

Notwithstanding the above, vehicle restraint devices as described above are distinguished for various negative characteristics, in terms of security, configuration and installation difficulties. Such devices are often bulky, both in a longitudinal and transverse direction. This limits the space that can be utilised for pavements, kerbs and hard shoulders, and also the roadways themselves. Due to the size of such devices, it may not be practically feasible to protect fixed obstacles that remain so utterly exposed to traffic without any protection.

Given the complexity of their design, the above-described vehicle restraint devices are made up of a multitude of components and are all different from each other. This complexity implies a high probability of incorrect installation if not performed by highly skilled and educated personnel. The operating mechanisms of such shock absorbers, based in most cases on reciprocal sliding metal sections, if not installed correctly fail, creating situations of great danger for impactful vehicles.

In view of the above, there is a need for an improved protective device for road crash barriers or any fixed road obstacles.

SUMMARY

According to the present invention there is provided a terminal for a road crash barrier as detailed in claim 1. Advantageous features are claimed in the dependent claims.

The terminal constitutes a vehicle restraint system for road safety, which is configured to reduce damage to vehicles, objects and people following a possible head-on collision and/or side collision against the start and/or end of any road barrier or against any fixed obstacle.

Due to its modular design, the terminal can be easily configured depending on the extent of the probable impact expected.

Due to the particular shape of a front part of the terminal, in the event of a frontal and/or misaligned collision, the terminal is configured to reduce any yaw motions induced on the vehicles and/or impact objects.

The terminal may comprise at least one of a metallic, fibre, plastic, or composite material.

Due to its structural simplicity and reduced diversity of its components, the terminal of the present disclosure can be easily assembled on site without incurring any installation errors which would be extremely dangerous in the event of impact.

The terminal of the present disclosure is configured to interface with the end portion of a crash barrier.

BRIEF DESCRIPTION OF THE DRAWINGS

The present application will now be described with reference to the accompanying drawings in which.

DETAILED DESCRIPTION OF THE DRAWINGS

The present disclosure provides a modular terminal apparatus configured to be attached to an end portion of a road crash barrier. In the context of the present disclosure, the end portion of a road crash barrier refers to the portion thereof which faces incoming traffic at the side or central reserve of a roadway. For example, the terminal of the present disclosure may be deployed at the junction between a motorway and a sliproad leading from the motorway.

It will be understood by those skilled in the art that a terminal is a type of vehicle restraint system. More specifically, a terminal refers to a treatment at the beginning and/or the end of a safety or road crash barrier. A terminal is designed to be installed at the beginning and/or the end of a barrier. A terminal can provide an anchorage for the barrier. The length of a terminal is the longitudinal distance from the nose to the end of the terminal, i.e., to the beginning of the barrier. A terminal should be smoothly joined to a barrier. In general, a terminal is designed to provide an anchorage to the barrier and to have adequate reaction to the axial push from the barrier. As described above, a crash cushion is a different type of vehicle restraint device. In this regard, a crash cushion is usually not connected to the obstacle that it protects. A crash cushion is always energy absorbing, while a terminal can be energy absorbing or non-energy absorbing. The present disclosure provides a terminal as defined above and as described below.

The terminal of the present disclosure comprises: a plurality of energy absorbing modules configured to be arranged in a linear formation along a longitudinal axis, each module defining a hollow section; and at least two anchors for anchoring the energy absorbing modules, wherein at least one of the energy absorbing modules is supported by a flexible linear member between the at least two anchors.

The energy absorbing modules are discrete entities and may be arranged in a linear configuration in series with each other. The modules may be arranged linearly, in an array extending away from the end of the crash barrier, in a direction leading parallel to, and toward the flow of traffic. The modules may be arranged to be aligned with the longitudinal axis of the crash barrier which they protect. It will be understood that due to its modular configuration, the terminal can be configured according to the environment in which it is deployed. That is, modules can be added to and removed from the terminal apparatus depending on requirements.

Figure 1A:
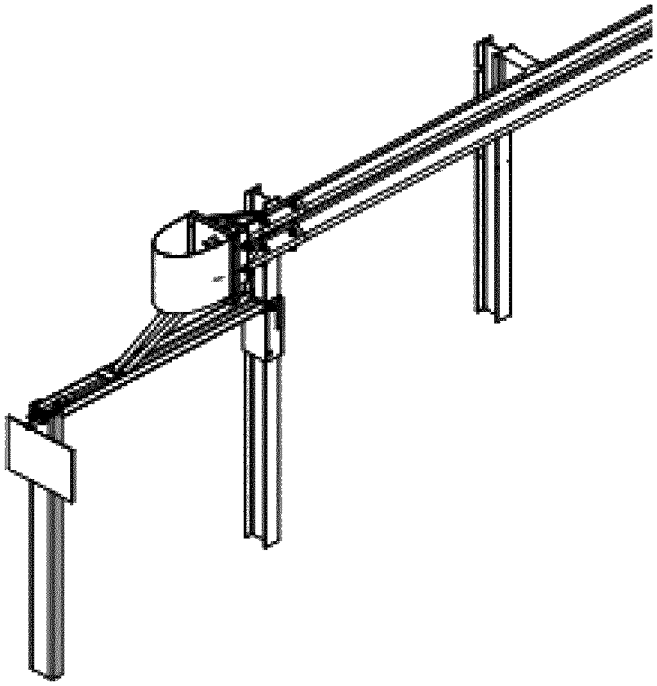
FIGS. 1*a* to 1*b* illustrate examples of conventional end terminals for crash barriers.
Figure 1B:
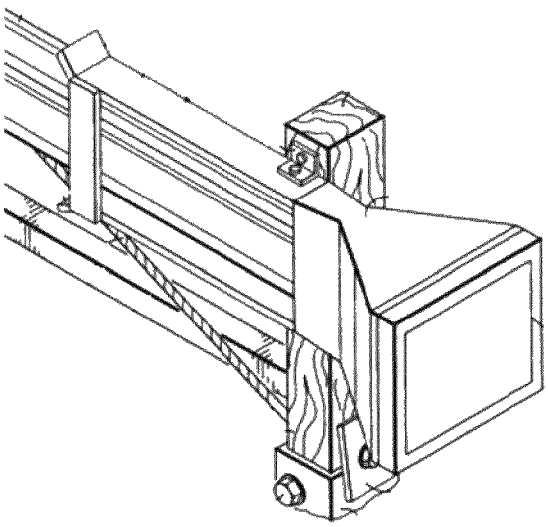
Figure 1C:
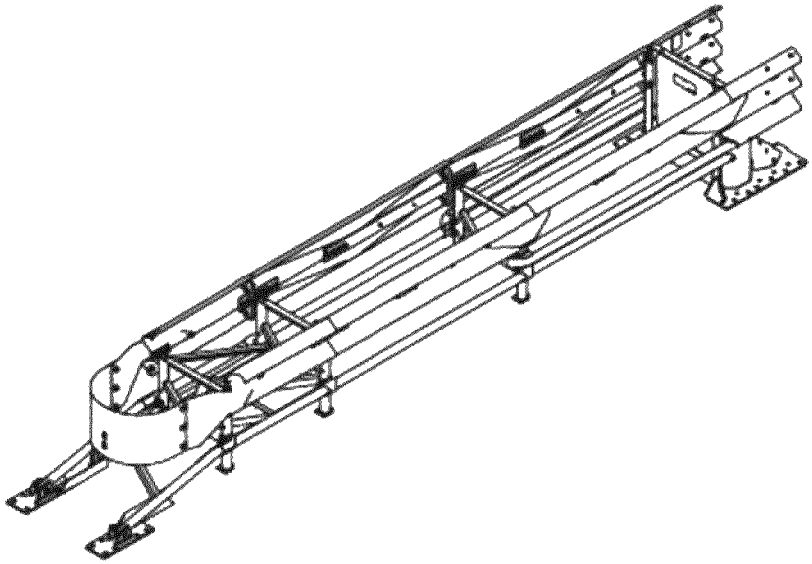
FIG. 1*c* illustrates an example of a conventional crash cushion to be installed in front of a road crash barrier.
Figure 1D:
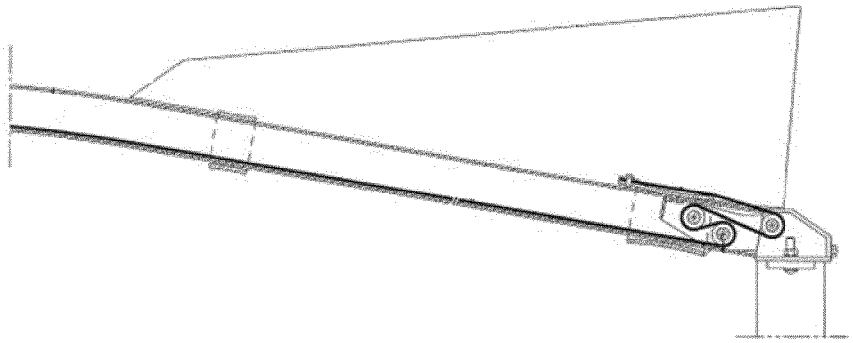
FIG. 1*d* illustrates an example of another type of vehicle restraint device.
Figure 2:
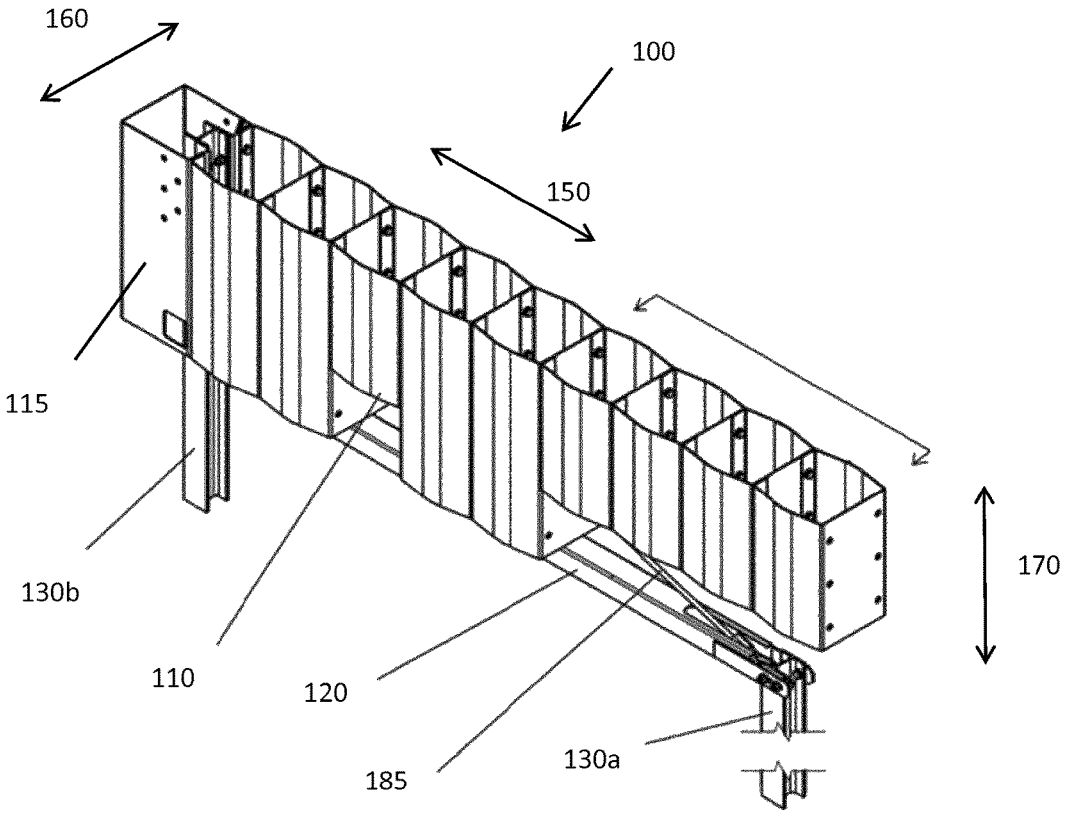
FIG. 2 is a perspective view of a terminal for a road crash barrier according to an embodiment of the present disclosure.

Each of the modules of the terminal defines a hollow or cavity section. A substantial portion of each of the modules may be hollow. This allows for deformation of the entire terminal and provides energy or shock absorption functionality. The modules may be formed of a sheet material to define the hollow section. In this regard, each of the modules may be in the form of a tubular member. When installed, the modules may have corresponding openings aligned in a direction substantially orthogonal to the longitudinal and transverse axes of the terminal. The shape of the modules may be cylindrical, parallelepiped or a composite shape. The tubular member may have a cross section defining opposite sidewalls. The tubular member may have a parallelepiped shape comprising a quadrilateral cross section defining opposite sidewall pairs along the longitudinal and transverse axes of the terminal. Referring to FIG. 2, the tubular member may have a composite shape with a cross section defining opposite planar sidewalls along the longitudinal axis of the terminal and opposite at cylindrical sidewalls along the transverse axis of the terminal.

The terminal may also comprise a ground rail. The ground rail may extend in the longitudinal axis in which the modules are arranged. The ground rail may extend along at least a portion of the longitudinal axis. Operationally, the ground rail may be disposed to extend along the ground just above ground level. This enables the energy absorbing modules to slide along an upper surface of the ground rail upon impact. The ground rail is provided to reduce friction on uneven ground. One or more of the modules may be configured to slide along the ground rail, and one or more others of the modules may be configured not to be in contact with the ground rail. The one or more modules which are not in contact with the ground rail may be cantilevered off other modules in the longitudinal axis. The effect of having one or more cantilevered modules which do not contact the ground rail is to decrease the effect of yaw of an object and/or vehicle impacting the front and/or sides of the terminal.

Figure 3:
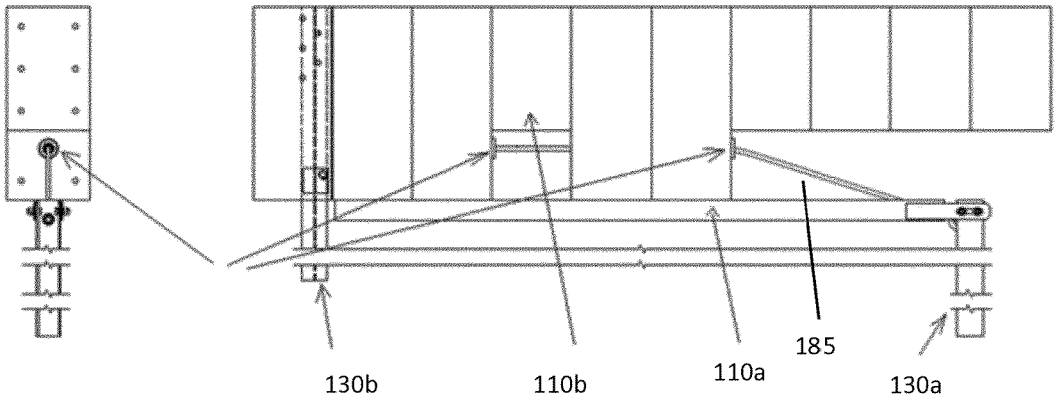
FIG. 3 is a side view of the terminal of FIG. 2, according to an embodiment of the present disclosure.

FIG. 2 is a perspective view of a terminal 100 according to an embodiment of the present disclosure. Referring to FIG. 2, the terminal 100 comprises one or more energy absorbing modules 110 each defining a hollow or cavity section. The modules 110 are arranged linearly in series with each other, in an array extending away from the end of a crash barrier. The modules 110 may be arranged in a direction parallel to, and toward the flow of traffic. The modules 110 may be arranged to be aligned with the longitudinal axis of the crash barrier which they protect. As shown in FIG. 2, the modules 110 are arranged in a longitudinal axis 150 of the terminal 100. The longitudinal axis 150 corresponds to the direction parallel to and toward the flow of traffic and the longitudinal axis of the crash barrier which they protect. Referring to FIG. 2, a transverse axis 160 of the terminal 100 refers to a direction facing the terminal 100 side-on. That is, the side view of the terminal 100 illustrated in FIG. 3 is in the transverse direction 160. It will be understood that the terminal 100 is configured to protect against impacts not only in the longitudinal axis but also in the transverse axis and at inclined angles. For example, an errant vehicle or other object may veer off the road and impact on the side of the terminal 100 at an inclined angle.

Each of the modules 110 may have a cylindrical, parallelepiped or composite shape. Referring to FIG. 2, each of the modules 110 may have a composite shape with a cross section defining opposite planar sidewalls along the longitudinal axis of the terminal 100 and opposite cylindrical sidewalls along the transverse axis of the terminal 100.

The energy absorbing modules 110 may be configured to be connected to each other by any suitable means such as by screws or rivets, as illustrated in FIGS. 2 and 3. Referring to FIGS. 2 and 3, the rightmost module 110 is the front of the terminal 100 as depicted, and the leftmost module 110 is the rear of the terminal 100. That is, the front of the terminal 100 refers to the end of the terminal 100 that faces oncoming traffic. The rear of the terminal 100 refers to the end of the terminal 100 that is configured to be removably attached to the end portion of the crash barrier.

The terminal 100 comprises at least two anchors 130 for anchoring the energy absorbing modules 110. The energy absorbing modules 110 are supported by a flexible linear member 185 between the at least two anchors 130. As the terminal 100 will be generally deployed in the central reserve or to the side of a roadway, the terminal 100 will typically need to be anchored in the ground. Each of the anchors 130 is deployed operationally in a substantially upright configuration. A substantial portion of each anchor 130 may be driven into the ground in an operational configuration. The anchors 130 may be arranged to extend substantially perpendicular to the longitudinal direction 150 in which the modules 110 are aligned. An anchoring axis 170 illustrated in FIGS. 1 and 2 refers to the direction in which the anchors 130 are aligned. It will be understood that the anchoring axis 170 is substantially perpendicular to both the longitudinal axis 150 and the transverse axis 160. It will be further understood that the anchors 130 may be aligned in a substantially vertical configuration for anchoring the modules 110. Each of the anchors 130 may comprise a post having for example a H cross-section. The anchors 130 may be anchored in the ground, such as in soil, under the terminal 100. In one embodiment, the terminal 100 may comprise a front anchor **130*a* and a rear anchor 130*b* as illustrated in FIGS. 2 and 3. However, in other embodiments, three or more anchors 130 may be deployed if there are a substantial number of modules 110 employed. In such embodiments, a flexible linear member may be configured to extend between neighbouring sets of anchors. As mentioned above, the anchors 130 are configured to anchor the energy absorbing modules 110, but also function to provide an anchorage for the barrier itself. That is, the terminal 100** also constitutes an anchorage for the barrier.

As mentioned above, the rear of the terminal 100 refers to the end of the terminal 100 that is configured to be removably attached to the end portion of the crash barrier. The terminal of any preceding claim, being configured to be connected to the road crash barrier using at least one connection plate. The terminal 100 may be configured to provide a single-sided connection to the road crash barrier using a connection plate provided on one lateral side of the terminal. The terminal 100 may also be configured to provide a double-sided connection to the road crash barrier using a connection plate provided on both lateral sides of the terminal 100. In this regard, the terminal 100 may further comprise an interface module 115 for removably attaching the terminal 100 to the road crash barrier. Referring to FIG. 2, the interface module 115 extends away from the rear anchor **130*b* towards the crash barrier. The interface module 115 may be removably attached to the rear anchor using any suitable connections means. The interface module 115 also defines a hollow section like the other modules 110. The interface module 115 is configured to be connected to the road crash barrier. In this regard, the interface module 115 may define apertures or the like for attaching the terminal 100 to the road crash barrier. The interface module 115 may be configured to receive a connection plate that receives the terminal 100**. The connection plate is configured to connect the terminal to the end of the road crash barrier. A connection plate may be provided on one or both lateral sides of the terminal. More specifically, a connection plate may be provided on at least the road side of the terminal when installed, but may also be provided on both lateral sides to provide a double-sided connection. The road or traffic side of the terminal will be understood to be the side of the terminal facing the road. The connection may be configured to be capable of withstanding a 15 degree impact of a 1500 kg vehicle travelling at 110 kmph. The connection may be tested in both lateral directions to confirm performance.

As mentioned above, the terminal 100 may also comprise a linear ground rail 120. The linear ground rail 120 may be configured so that one or more of the modules 110 may slide laterally thereon in the event of impact and deformation of the modules 110. The linear ground rail 120 is provided to reduce friction on uneven ground. As described above, the linear ground rail 120 may comprise a rail extending at ground level along at least a portion of the length of the terminal 100. In an operational configuration, the ground rail 120 may be connected between the anchors 130 and configured to extend at ground level along the longitudinal axis. That is, the linear ground rail 120 may extend along the longitudinal axis 150 of the terminal 100. An upper surface of the ground rail 120 may be operationally disposed at a height above ground level. One or more of the modules 110 may be configured to contact the ground rail 120. One or more other modules 110 may be configured not to contact the ground rail 120. In this regard, the modules 110 may comprise at least one ground rail-contacting module 110*a* having a first height and at least one non ground rail-contacting module 110*b* having a second height, wherein the first height is greater than the second height. In the context of the present disclosure, and how the terminal is deployed in an operational configuration, it will be understood that the height of the modules refers to a substantially vertical distance by which the modules 110 extend. Referring to FIGS. 2 and 3, the terminal 100 may comprise one or more ground rail-contacting modules 110*a* and one or more non ground rail-contacting modules 110*b*. The one or more ground rail-contacting modules 110*a* are operationally configured to contact the ground rail 120. The one or more ground rail-contacting modules 110*a* are configured to be supported by at least one of the ground rail 120 beneath, their attachment to neighbouring modules 110, and a flexible linear member that extends between the anchors 130. The one or more non ground rail-contacting modules 110*b* are operationally configured not to contact the ground rail 120. The one or more non ground rail-contacting modules 110*b* are supported by virtue of their attachment to neighbouring modules 110. In this regard, referring to FIGS. 2 and 3, the one or more non ground rail-contacting modules 110*b* may be cantilevered from one or more other of the other modules 110 in the longitudinal axis. Referring to FIGS. 2 and 3, a ground rail-contacting module 110*a* may be disposed at the rear of the terminal 100 between the anchors 130. The ground rail-contacting module 110*a* may be removably attached to the rear anchor 130*b* using any suitable connection means as would be known in the art.

Operationally, the front anchor 130*a* may extend from the ground to the ground rail 120. Operationally, the rear anchor 130*b* may extend from the ground to the height of the module 110 at the rear of the terminal 100. The rear anchor 130*b* may also be configured to be connected to the ground rail 120.

The linear ground rail 120 may be removably attached between the anchors 130 and supported by the anchors 130. For example, the ground rail 120 may be removably attached to the front anchor 130*a* and the rear anchor 130*b*.

Each of the modules 110 may be formed of metal or plastic. For example, the modules may comprise steel, aluminium, carbon fibre, aluminium foam, Kevlar®, polycarbonate, or any combination thereof.

Referring to FIG. 3, a flexible linear member 185 for supporting and/or securing the modules 110 together may extend between the anchors 130. In the example of FIGS. 2 and 3, the flexible linear member 185 may extend between the front anchor 130*a* and the rear anchor 130*b*. The flexible linear member 185 helps to reduce deformation of the terminal 100 on impact. The flexible linear member 185 may extend through the hollow section of each of the modules 110. The flexible linear member 185 may pass from the front anchor 130*a* to the rear anchor 130*b* via one or more of the modules 110. Specifically the flexible linear member 185 may pass through at least one ground rail-contacting module 110*a*. Referring to FIG. 3, the flexible linear member 185 may extend at an inclined angle from the front anchor 130*a* and pass through the ground rail-contacting modules 110*a* before extending at an inclined angle to the rear anchor 130*b*. In this regard, the ground rail-contacting modules 110*a* may define apertures in the longitudinal axis direction of the shock absorber for allowing the flexible linear member 185 to pass through.

The flexible linear member 185 may be secured between the anchors 130. The flexible linear member 185 may be removably attached to the front anchor 130*a* using any suitable means, such as via a thimble and eye mechanism, as would be understood by those skilled in the art. The flexible linear member 185 may be removably attached to the rear anchor 130*b* using an adjustable tension mechanism. That is, the tension of the flexible linear member 185 may be adjusted at the rear anchor 130*b*. In this manner, the tension of the flexible linear member 185 may be adjusted according to the number of modules in the apparatus or the situation in which the apparatus is deployed.

It will be understood that the flexible linear member 185 may be a metallic cable, rope or linear plastic member. The flexible linear member 185 may comprise steel, aluminium, carbon fibre, aluminium foam, Kevlar®, polycarbonate, or any combination thereof.

Referring to FIG. 3, the non ground rail-contacting modules 110*b* operationally do not contact the flexible linear member 185. This configuration avoids excessive friction between the modules 110 during the deformation of the energy absorbing modules 110. Also as mentioned above, the provision of modules 110 which do not contact the ground rail helps to reduce any yaw motions induced on vehicles and/or other objects impacting the terminal.

Figure 4:
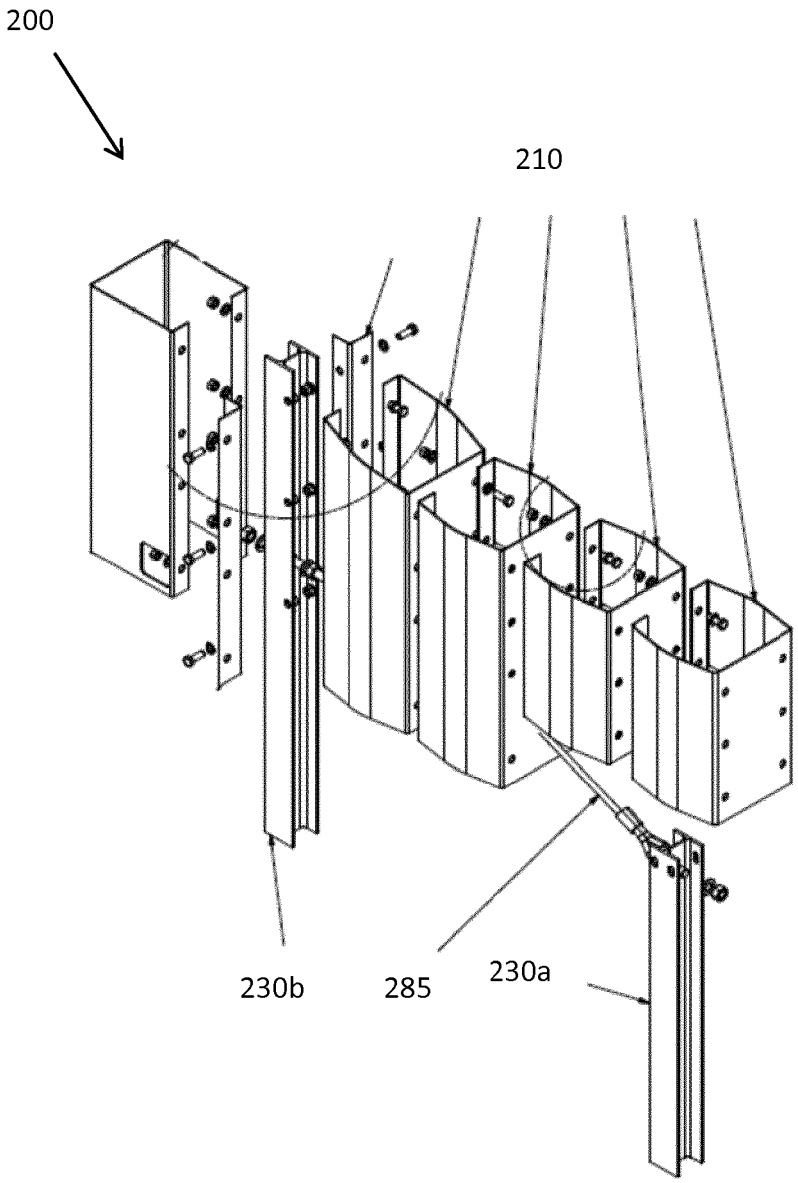
FIG. 4 illustrates a terminal for a road crash barrier, according to another embodiment of the present disclosure.

In FIGS. 2 and 3, the ground rail 120 extends along the entire length of the terminal 100. However, in other embodiments the ground rail may extend only along a portion of the entire length of the terminal. In this regard, the ground rail may be configured to extend only along a portion of the length of the terminal which corresponds to possible movement of ground rail-contacting modules. The ground rail may be configured to be positioned appropriately to allow for movement of the ground rail-contacting modules in the longitudinal axis in the event of impact. That is, a ground rail portion is only required at locations where there are likely to be ranges of movement of ground rail-contacting modules. In this regard, the ground rail may be discontinuously formed. For example, the ground rail may extend only approximately half-way from the rear anchor towards the front anchor. In other configurations, a plurality of discontinuous ground rail portions may be located in the longitudinal axis. In other embodiments, the terminal may not comprise a ground rail at all. FIG. 4 illustrates a terminal 200 according to another embodiment of the disclosure. Referring to FIG. 4, the terminal 200 has only four energy absorbing modules 210. The terminal 200 may also comprise a front anchor 230*a* and a rear anchor 230*b*. In situations where the number of modules in the terminal is relatively low, a ground rail may not be required. In this case, the modules 210 are supported by a linear flexible member 285. It will be understood by the skilled person that the terminal can be configured according to the location in which it is deployed. That is, the number of energy absorbing modules may be varied according to the speed limit of the road in question.

Figure 5:
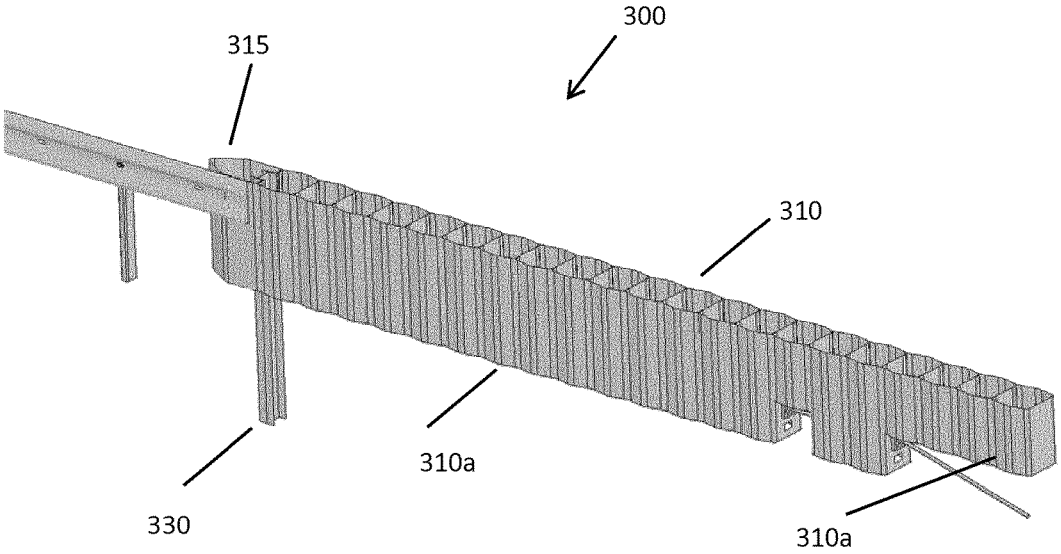
FIG. 5 illustrates a terminal for a road crash barrier, according to another embodiment of the present disclosure.

FIG. 5 illustrates a terminal 300 according to another embodiment of the present disclosure. Referring to FIG. 5, each of a plurality of energy absorbing modules 310 has a tubular shape. It will be appreciated from FIG. 5 that the number of energy absorbing modules 310 is greater than that of the previous embodiments. The terminal 300 has a plurality of a plurality of non-ground rail-contacting modules 310*a* and a plurality of ground rail-contacting modules

310*a*. For purposes of clarity, the ground rail is not illustrated in FIG. 5. The terminal 300 also comprises an interface module 315 for removably attaching the terminal 300 to the road crash barrier. In FIG. 5, the interface module 315 is attached to a rear of the crash barrier. The interface module 315 may be configured to have a different shape to the other energy absorbing modules 310. In this regard, the interface module 315 may be specifically configured to be attached to the crash barrier. An anchor 330 is illustrated in FIG. 5. It will be appreciated that this anchor 330 is a rear anchor and a substantial portion of the anchor 330 is to be submerged operationally in the ground.

Figure 6:
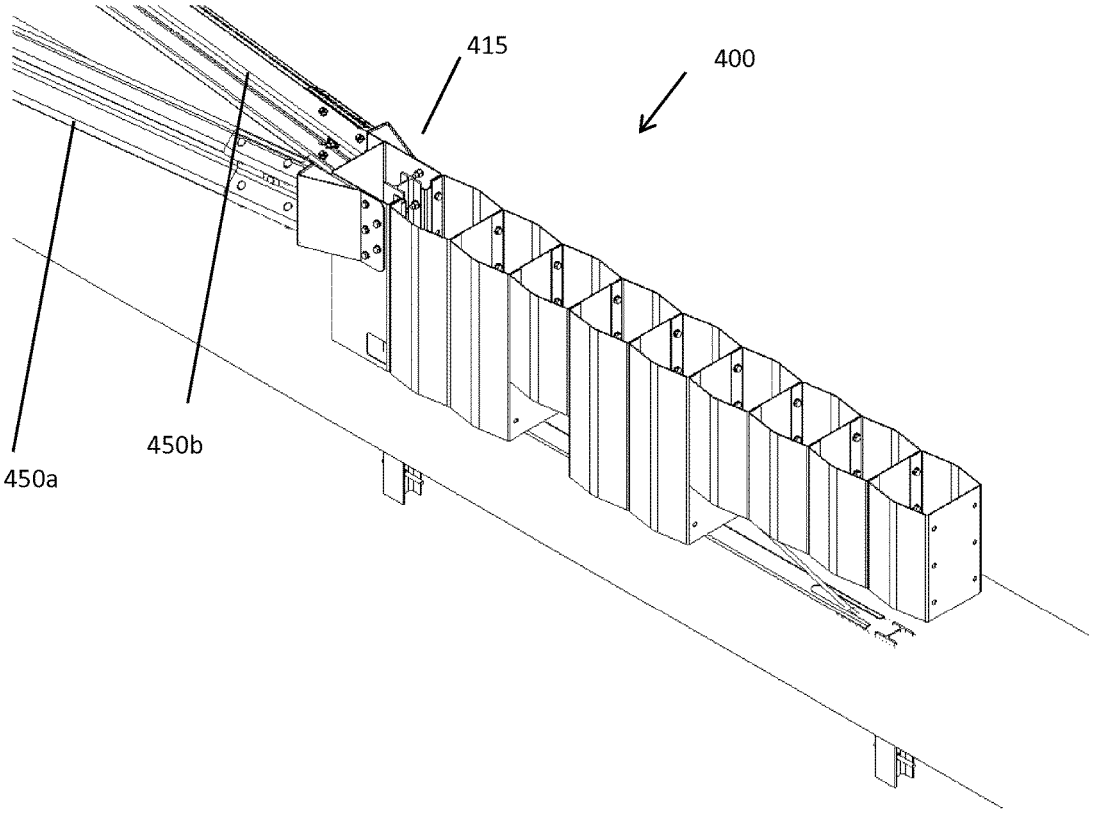
FIG. 6 illustrates a terminal for a road crash barrier, according to another embodiment of the present disclosure.

FIG. 6 illustrates a terminal 400 for a road crash barrier, according to another embodiment of the present disclosure. Referring to FIG. 6, the terminal 400 comprises an interface module 415 for removably attaching the terminal 400 to the road crash barrier. The interface module 415 is configured to receive connection plates 450*a* and 450*b* that receive the terminal 400. The connection plates 450*a* and 450*b* are configured to connect the terminal 400 to the end of the road crash barrier. As illustrated, the connection plates 450*a* and 450*b* are provided on both lateral sides of the terminal 400 to provide a double-sided connection. The connection may be configured to be capable of withstanding a 15 degree impact of a 1500 kg vehicle travelling at 110 kmph. The connection may be tested in both lateral directions to confirm performance.

The terminal of the present disclosure, when attached to the end of a roadside crash barrier, protects the occupants of a vehicle by progressively absorbing the force of impact of the vehicle before the vehicle reaches the end of the barrier or wall. The modular shock absorber according to the present disclosure is configured to be quickly and inexpensively attached to the end of a roadside crash barrier, and may be manufactured at a site remote from the roadside crash barrier or barrier wall which it is attached. Further, due to its modular configuration, the terminal can be configured in a specific size according to the environment in which it is deployed.

The words comprises/comprising when used in this specification are to specify the presence of stated features, integers, steps or components but does not preclude the presence or addition of one or more other features, integers, steps, components or groups thereof.

The invention claimed is:

1. A terminal configured to be attached to and anchor an end portion of a road crash barrier, the terminal comprising:

a plurality of energy absorbing modules arranged in a linear formation along a longitudinal axis, each module defining a hollow section; and at least two anchors for anchoring the energy absorbing modules, wherein the at least two anchors also function to provide an anchorage for the barrier itself;

wherein at least one of the energy absorbing modules is supported by a flexible linear member between the at least two anchors.

2. The terminal of claim 1, wherein each of the modules is configured to be connected to another of the modules.

3. The terminal of claim 1, comprising a linear ground rail configured to allow the modules to slide thereon.

4. The terminal of claim 3, wherein operationally, at least one of the modules is configured to slide along the ground rail and at least one other module is configured not to contact the ground rail.

5. The terminal of claim 3, comprising at least one ground rail-contacting module having a first height and at least one non ground rail-contacting module having a second height, wherein the first height is greater than the second height.

6. The terminal of claim 5, wherein the at least one ground rail-contacting module is operationally supported by at least one of the flexible linear member, the ground rail and their attachment to neighbouring modules.

7. The terminal of claim 5, wherein the at least one non ground rail-contacting module is operationally supported by its attachment to neighbouring modules.

8. The terminal of claim 3, wherein the ground rail is connected to and extends between the anchors.

9. The terminal of claim 3, wherein the ground rail extends continuously between the anchors.

10. The terminal of claim 3, wherein the ground rail extends discontinuously between the anchors.

11. The terminal of claim 5, wherein a ground rail-contacting module is disposed at the rear of the terminal between the anchors.

12. The terminal of claim 5, wherein a non ground rail-contacting module is disposed at the front of the terminal between the anchors.

13. The terminal of claim 1, comprising a front anchor and a rear anchor.

14. The terminal of claim 13, wherein the rear anchor has a height which is greater than the front anchor.

15. The terminal of claim 1, wherein the flexible linear member extends through the hollow section of one or more of the energy absorbing modules.

16. The terminal of claim 13, wherein the flexible linear member extends from the front anchor to the rear anchor.

17. The terminal of claim 16, wherein the flexible linear member passes from the front anchor to the rear anchor via one or more of the modules.

18. The terminal of claim 17, wherein the flexible linear member passes through at least one ground rail-contacting module.

19. The terminal of claim 5, wherein the flexible linear member is configured to extend at an inclined angle from a first anchor and pass through at least one ground rail-contacting module before extending at an inclined angle to a second anchor.

20. The terminal of claim 16, wherein the flexible linear member is configured to be removably attached to the rear anchor using an adjustable tension mechanism.

21. The terminal of claim 1, being configured to be connected to the road crash barrier using at least one connection plate.

* * * * *